US009431796B2

(12) United States Patent
Ichihara

(10) Patent No.: US 9,431,796 B2
(45) Date of Patent: Aug. 30, 2016

(54) METHOD FOR MANUFACTURING SPARK PLUG

(75) Inventor: Hiroshi Ichihara, Kasugai (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 184 days.

(21) Appl. No.: 14/006,290

(22) PCT Filed: Mar. 13, 2012

(86) PCT No.: PCT/JP2012/001713

§ 371 (c)(1),
(2), (4) Date: Sep. 19, 2013

(87) PCT Pub. No.: WO2012/140833

PCT Pub. Date: Oct. 18, 2012

(65) Prior Publication Data

US 2014/0011417 A1 Jan. 9, 2014

(30) Foreign Application Priority Data

Apr. 14, 2011 (JP) ..... 2011-089754

(51) Int. Cl.

| | |
|---|---|
| ***H01T 21/02*** | (2006.01) |
| ***H01T 21/06*** | (2006.01) |
| *H01T 13/20* | (2006.01) |
| *H01T 13/39* | (2006.01) |

(52) U.S. Cl.

CPC ..... *H01T 21/02* (2013.01); *H01T 21/06* (2013.01); *H01T 13/20* (2013.01); *H01T 13/39* (2013.01)

(58) Field of Classification Search

CPC ..... H01T 21/06
USPC ..... 445/3, 4, 7
See application file for complete search history.

(56) References Cited

U.S. PATENT DOCUMENTS

| | | | | |
|---|---|---|---|---|
| 5,725,405 | A * | 3/1998 | Nakatani | H01T 21/02 445/4 |
| 6,595,818 | B2 | 7/2003 | Uehara | |
| 6,659,826 | B2 | 12/2003 | Hanai | |
| 2002/0034915 | A1* | 3/2002 | Nakatani | H01T 21/06 445/2 |
| 2002/0081932 | A1 | 6/2002 | Hanai | |
| 2002/0092835 | A1 | 7/2002 | Uehara | |
| 2002/0102898 | A1* | 8/2002 | Ito | H01T 21/02 445/4 |
| 2002/0142696 | A1* | 10/2002 | Ito | H01T 21/02 445/3 |
| 2004/0067712 | A1* | 4/2004 | Hanai | H01T 21/06 445/4 |
| 2004/0192155 | A1* | 9/2004 | Taniguchi | H01T 21/02 445/70 |
| 2005/0039332 | A1* | 2/2005 | Oda | H01T 21/02 29/882 |

(Continued)

FOREIGN PATENT DOCUMENTS

| | | | |
|---|---|---|---|
| JP | 2002-198157 | A | 7/2002 |
| JP | 2002-216930 | A | 8/2002 |
| JP | 2002-321063 | A | 11/2002 |
| JP | 2009-163923 | A | 7/2009 |
| JP | 2009-301733 | A | 12/2009 |

OTHER PUBLICATIONS

International Search Report mailed Jun. 12, 2012 for the corresponding PCT Application No. PCT/JP2012/001713.

*Primary Examiner* — Anh Mai
*Assistant Examiner* — Zachary J Snyder
(74) *Attorney, Agent, or Firm* — Leason Ellis LLP

(57) ABSTRACT

A method for manufacturing a spark plug includes a transfer step of transferring a first tip to a joining position where the first tip is joined to a tip-mating member. The transfer step includes a step of performing positional correction for the first tip before the first tip reaches the joining position.

14 Claims, 11 Drawing Sheets

(56) References Cited

U.S. PATENT DOCUMENTS

2005/0042965 A1* 2/2005 Oda ..... H01T 21/02 445/7
2006/0202599 A1* 9/2006 Kato ..... H01T 13/14 313/143
2006/0223406 A1* 10/2006 Mueller et al. ..... 445/7
2007/0054581 A1* 3/2007 Fujita et al. ..... 445/7
2007/0114900 A1* 5/2007 Lykowski ..... H01T 13/20 313/141
2009/0322198 A1* 12/2009 Kameda ..... H01T 21/02 313/141

* cited by examiner

METHOD FOR MANUFACTURING SPARK PLUG

CROSS REFERENCE OF RELATED APPLICATIONS

This application is a U.S. National Phase Application under 35 U.S.C. §371 of International Patent Application No. PCT/JP2012/001713, filed Mar. 13, 2012, and claims the benefit of Japanese Patent Application No. 2011-89754 filed in Japan on Apr. 14, 2011, all of which are incorporated by reference in their entities herein. The International Application was published in Japanese on Oct. 18, 2012 as International Publication No. WO/2012/140833 under PCT Article 21(2).

FIELD OF THE INVENTION

The present invention relates to a method for manufacturing a spark plug.

BACKGROUND OF THE INVENTION

A conventionally used spark plug has a noble metal tip provided at a distal end portion of an electrode. Manufacturing such a spark plug usually employs the following processes: a composite tip is formed by joining a noble metal tip to an intermediate tip (e.g., an Ni tip), and the intermediate tip of the composite tip is joined to a distal end portion of an electrode.

However, since the noble metal tip and the intermediate tip are such small members as to have a diameter of about 1 mm or so, forming the composite tip by joining the two members together has encountered difficulty in correctly setting up the relative positional relationship therebetween. Also, for example, in manually positioning the noble metal tip and the intermediate tip, the positional adjustment has consumed time. Such problems do not exclusively arise in a process of joining the noble metal tip to the intermediate tip, but have generally arisen in attempting to correctly set up the relative positional relationship between two tips before joining them together. Also, similar problems have arisen in joining a tip, such as a noble metal tip, directly to a center electrode or a ground electrode.

PRIOR ART DOCUMENT

Patent Document

Patent Document 1: Japanese Patent Application Laid-Open (kokai) No. 2009-163923

Patent Document 2: Japanese Patent Application Laid-Open (kokai) No. 2002-198157

Problem to be Solved by the Invention

An object of the present invention is to provide a technique for easily and correctly adjusting the position of a particular tip in relation to a tip-mating member in joining the particular tip to the tip-mating member.

SUMMARY OF THE INVENTION

Means for Solving the Problem

The present invention has been conceived to solve, at least partially, the above problem and can be embodied in the following modes or application examples.

Application Example 1

A method for manufacturing a spark plug which comprises the steps of:

providing a center electrode, providing an insulator disposed externally of an outer circumference of the center electrode, providing a metallic shell disposed externally of an outer circumference of the insulator, providing a ground electrode whose one end portion is joined to the metallic shell and whose other end portion faces the center electrode, providing a first tip which forms a gap in cooperation with the ground electrode or the center electrode, said first tip being disposed at the center electrode and/or the ground electrode and being joined to a tip-mating member, and transferring the first tip to a joining position where the first tip is joined to the tip-mating member, wherein the transfer step comprises a step of performing positional correction for the first tip before the first tip reaches the joining position.

According to this configuration, in the transfer step of transferring the first tip to the joining position where the first tip is joined to the tip-mating member, positional correction is performed for the first tip before the first tip reaches the joining position. Therefore, the positional relationship between the first tip and the tip-mating member can be adjusted easily and correctly. Also, since the step of performing positional correction for the first tip and the step of joining the first tip to the tip-mating member can be performed separately at respectively favorable timings, production efficiency can be improved.

Application Example 2

A method for manufacturing a spark plug according to application example 1, wherein the positional correction for the first tip is performed by gripping the first tip using a position-correcting chuck.

According to this method, since the first tip is gripped with the position-correcting chuck and is thereby corrected for position, the positional relationship between the first tip and the tip-mating member can be adjusted easily and correctly.

Application Example 3

A method for manufacturing a spark plug according to application example 1 or 2, wherein the positional correction is performed at a middle position between a feed position where the first tip is fed, and the joining position.

According to this configuration, since positional correction for the first tip is performed at a middle position between the feed position and the joining position, the positional correction can be performed in a sufficiently loose condition in terms of time and position.

Application Example 4

A method for manufacturing a spark plug according to any one of application examples 1 to 3, wherein the step of transferring comprises (a) a step of moving, by use of a first feed device, the first tip to a middle position between a feed position where the first tip is fed, and the joining position, (b) a step of performing positional correction for the first tip at the middle position by gripping the first tip using a position-correcting chuck which grips the first tip, and (c) a step of, after the positional correction, moving the first tip from the middle position to the joining position by use of a transfer chuck, with the first tip being chucked with the transfer chuck.

According to this configuration, after positional correction for the first tip is performed at the middle position by use of the position-correcting chuck, the first tip is gripped with and moved by use of the transfer chuck. Therefore, the first tip can be properly transferred in a positionally corrected condition from the middle position to the joining position.

Application Example 5

A method for manufacturing a spark plug according to application example 4, wherein the first feed device and the transfer chuck are configured such that transfer is repeated with a horizontal distance therebetween being fixed;

there are simultaneously performed a first moving process in which, in the step (a), the first feed device moves one first tip from the feed position to the middle position, and a second moving process in which, in the step (c), the transfer chuck moves another first tip from the middle position to the joining position; and the positional correction in the step (b) is performed in the course of return of the first feed device from the middle position to the feed position and in the course of return of the transfer chuck from the joining position to the middle position.

According to this configuration, since the moving processes in the step (a) and the step (c) are performed simultaneously, the overall process can be completed in a short period of time.

Application Example 6

A method for manufacturing a spark plug according to application example 4 or 5, wherein a gripping member of the transfer chuck has a thickness greater than that of a gripping member of the position-correcting chuck.

According to this configuration, the transfer chuck can more reliably grip the first tip in transfer of the first tip, thereby reducing the possibility of a positional shift of the first tip in the midst of transfer.

Application Example 7

A method for manufacturing a spark plug according to any one of application examples 1 to 6, wherein positional correction for the first tip is performed in a state in which a bottom surface of the first tip is vacuum-chucked by use of a vacuum chuck port provided in a placement table on which the first tip is placed.

According to this configuration, since positional correction is performed with the bottom surface of the first tip being vacuum-chucked, when the position-correcting chuck is to grip the first tip, an unintended movement (for example, the position-correcting chuck flicks the first tip) can be restrained.

Application Example 8

A method for manufacturing a spark plug according to any one of application examples 1 to 7, wherein at least one of the center electrode and the ground electrode has a composite tip;

the composite tip is such that a first tip which forms a gap in cooperation with the center electrode or the ground electrode, and a second tip which connects the first tip to the center electrode or the ground electrode, are joined together; and the second tip is the tip-mating member.

According to this configuration, in the transfer step of transferring the first tip to the joining position where the first tip is joined to the second tip, positional correction for the first tip is performed by means of gripping the first tip with the position-correcting chuck; therefore, the positional relationship between the two tips which constitute the composite tip can be adjusted easily and correctly.

Application Example 9

A method for manufacturing a spark plug according to any one of application examples 1 to 7, wherein the center electrode is the tip-mating member.

According to this configuration, the positional relationship between the first tip and the center electrode can be adjusted easily and correctly.

Application Example 10

A method for manufacturing a spark plug according to any one of application examples 1 to 7, wherein the ground electrode is the tip-mating member.

According to this configuration, the positional relationship between the first tip and the ground electrode can be adjusted easily and correctly.

The present invention can be embodied in various forms. For example, the present invention can be embodied in a spark plug, a metallic shell for the spark plug, a method for manufacturing the spark plug, and a method for manufacturing the metallic shell.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

A. First Embodiment

Figure 1:
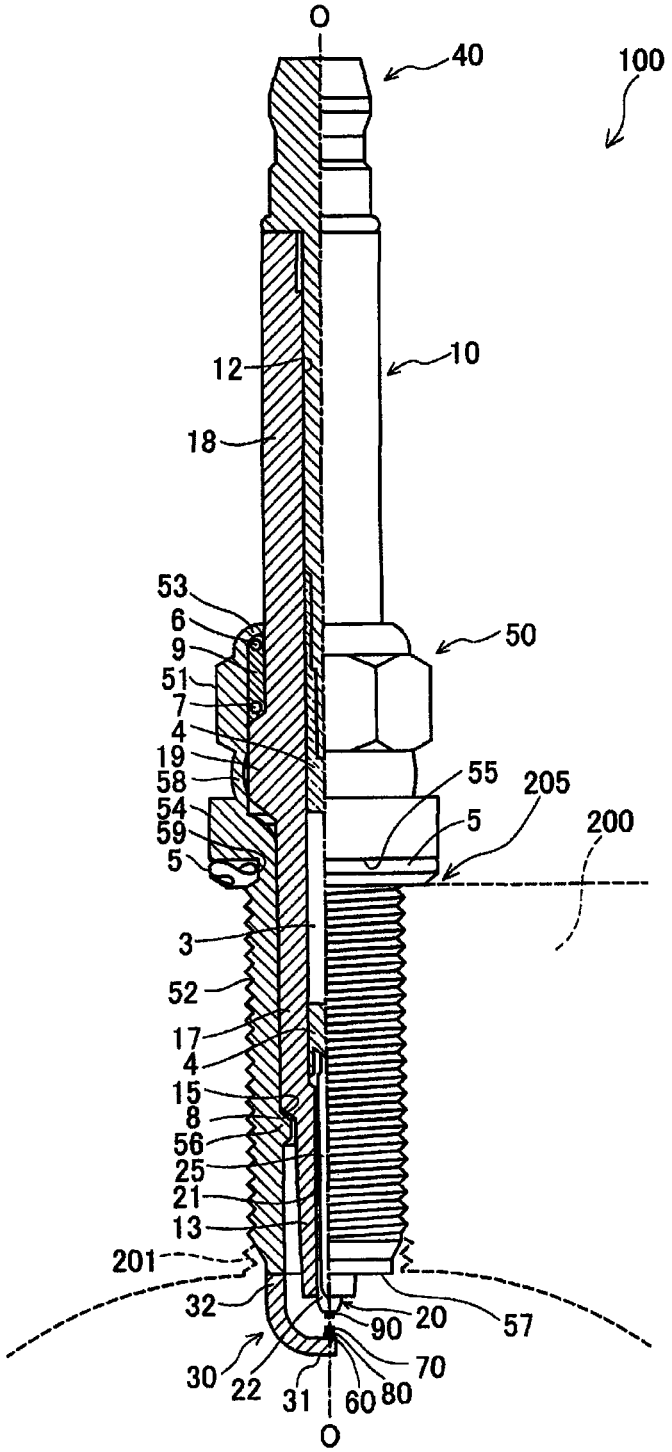
FIG. 1 is a partially sectional view of a spark plug according to an embodiment of the present invention.

FIG. 1 is a partially sectional view of a spark plug 100 according to an embodiment of the present invention. In the following description, the direction of an axis O of the spark plug 100 in FIG. 1 is referred to as the vertical direction in the drawings; the lower side is referred to as the forward side of the spark plug 100; and the upper side as the rear side. The spark plug 100 includes a ceramic insulator 10, a metallic shell 50, a center electrode 20, a ground electrode 30, and a metal terminal 40.

The ceramic insulator 10 is formed from, for example, alumina through firing. The ceramic insulator 10 is a tubular insulator and has an axial bore 12 coaxially extending therethrough in the direction of the axis O. The ceramic insulator 10 electrically insulates the center electrode 20 and the metallic shell 50 from each other. The ceramic insulator 10 has a collar portion 19 formed substantially at the center in the direction of the axis O and having the greatest outside diameter, and a rear trunk portion 18 formed rearward (upward in FIG. 1) of the collar portion 19. The ceramic insulator 10 also has a forward trunk portion 17 formed forward (downward in FIG. 1) of the collar portion 19 and being smaller in outside diameter than the rear trunk portion 18. The ceramic insulator 10 further has a leg portion 13 formed forward of the forward trunk portion 17 and being smaller in outside diameter than the forward trunk portion 17. The leg portion 13 reduces in outside diameter toward the forward end thereof. When the spark plug 100 is mounted to an engine head 200 of an internal combustion engine, the leg portion 13 is exposed to a combustion chamber of the internal combustion engine. A stepped portion 15 is formed between the leg portion 13 and the forward trunk portion 17.

The center electrode 20 is a rodlike electrode held in the ceramic insulator 10 along the direction of the axis O. The center electrode 20 has a structure in which a core 25 is embedded in an electrode base metal 21. The electrode base metal 21 is formed of nickel or a nickel alloy which contains nickel as a main component, such as INCONEL (trade name) 600 or 601. The core 25 is formed of copper or a copper alloy which contains copper as a main component, copper and the copper alloy being superior to the electrode base metal 21 in thermal conductivity. Usually, the center electrode 20 is manufactured as follows: the core 25 is fitted into the electrode base metal 21 formed into a closed-bottomed tubular shape; then, the resultant assembly is subjected to extrusion from the bottom side for prolongation. The core 25 has a substantially fixed outside diameter at its trunk portion and has a tapered forward end portion.

A forward end portion 22 of the center electrode 20 protrudes from the forward end of the ceramic insulator 10 and reduces in diameter toward the forward end thereof. In order to improve resistance to spark-induced erosion, a substantially circular columnar noble metal tip 90 formed of a noble metal having high melting point is joined to the forward end surface of the forward end portion 22 of the center electrode 20. The noble metal tip 90 can be formed of, for example, iridium (Ir) or an Ir alloy which contains iridium as a main component and one or more additive elements selected from among platinum (Pt), rhodium (Rh), ruthenium (Ru), palladium (Pd), rhenium (Re), etc.

The center electrode 20 and the noble metal tip 90 are joined together by full-circle laser welding with a laser beam radiated to the boundary between the noble metal tip 90 and the forward end portion 22 of the center electrode 20. In laser welding, since the two materials irradiated with a laser beam are fused and mixed, the noble metal tip 90 and the center electrode 20 are firmly joined together. The center electrode 20 extends rearward within the axial bore 12 and is electrically connected to the rear (upper in FIG. 1) metal terminal 40 via a seal member 4 and a ceramic resistor 3. A high-voltage cable (not shown) is connected via a plug cap (not shown) to the metal terminal 40 provided at the rear end of the ceramic insulator 10 so as to apply high voltage to the metal terminal 40.

The ground electrode 30 is welded at its proximal portion 32 to a forward end surface 57 of the metallic shell 50 and is disposed such that one side surface of its distal end portion 31 faces the forward end portion 22 of the center electrode 20. The ground electrode 30 is formed of a metal having high corrosion resistance; for example, a nickel alloy, such as INCONEL (trade name) 600 or 601. The ground electrode 30 has a substantially rectangular cross section across its longitudinal direction. The distal end portion 31 of the ground electrode 30 is bent such that one side surface of the distal end portion 31 faces, on the axis O, the noble metal tip 90 welded to the center electrode 20.

An intermediate tip 60 is joined to the distal end portion 31 of the ground electrode 30 on a plane which faces, on the axis O, the forward end portion 22 of the center electrode 20. The intermediate tip 60 can be formed of, for example, an Ni alloy which contains chromium (Cr), silicon (Si), manganese (Mn), aluminum (Al), etc. A noble metal tip 70 is joined to the intermediate tip 60 on a side (the upper side in the drawing) toward the forward end portion 22 of the center electrode 20. The intermediate tip 60 and the noble metal tip 70 are joined together by laser welding. As a result of fusion of the noble metal tip 70 and the intermediate tip 60, a fusion zone 80 is formed. The noble metal tip 70 can be formed of, for example, a Pt alloy which contains Pt as a main component, and one or more elements selected from among Rh, Ni, etc., as an additive(s).

As will be described later, in the course of manufacture of the spark plug, a composite tip is formed by joining the intermediate tip 60 and the noble metal tip 70 together, and the composite tip is joined to the distal end portion 31 of the ground electrode 30. Notably, the noble metal tip 70 may be called the "first tip," and the intermediate tip 60 may be called the "second tip."

The metallic shell 50 is a cylindrical metallic member adapted to fix the spark plug 100 to the engine head 200 of the internal combustion engine. The metallic shell 50 holds the ceramic insulator 10 therein. The metallic shell 50 is formed of low-carbon steel and has a tool engagement portion 51, to which an unillustrated spark plug wrench is fitted, and a mounting threaded portion 52, which has a thread formed thereon and is threadingly engaged with a mounting threaded hole 201 of the engine head 200 provided at an upper portion of the internal combustion engine.

The metallic shell 50 has a collar-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral-portion-around-opening 205 of the mounting threaded hole 201. The deformation of the gasket 5 provides a seal between the spark plug 100 and the engine head 200, thereby preventing gas leakage from inside the engine through the mounting threaded hole 201.

The metallic shell 50 has a thin-walled crimped portion 53 located rearward of the tool engagement portion 51. The metallic shell 50 also has a buckled portion 58, which is thin-walled similar to the crimped portion 53, between the seal portion 54 and the tool engagement portion 51. Annular ring members 6 and 7 intervene between the ceramic insulator 10 and an inner circumferential surface of the metallic shell 50 extending from the tool engagement portion 51 to the crimped portion 53; furthermore, a space between the two ring members 6 and 7 is filled with a powder of talc 9. When the precursor of the crimped portion 53 is bent inward and is thereby crimped, the ceramic insulator 10 is pressed forward within the metallic shell 50 via the ring members 6 and 7 and the talc 9. Accordingly, the stepped portion 15 of the ceramic insulator 10 is supported via the annular sheet packing 8 by a stepped portion 56 formed on the inner circumference of the metallic shell 50 at a position corresponding to the mounting threaded portion 52, whereby the metallic shell 50 and the insulator 10 are united together. At this time, gastightness between the metallic shell 50 and the ceramic insulator 10 is maintained by means of the annular sheet packing 8, thereby preventing outflow of combustion gas. The precursor of the buckled portion 58 is designed to be deformed outwardly in association with application of compressive force in a crimping process, thereby contributing toward increasing the length of compression of the talc 9 in the direction of the axis O and thus enhancing gastightness within the metallic shell 50. A predetermined clearance is provided between the metallic shell 50 and the insulator 10 in a forward end region.

The entire configuration of the spark plug 100 shown in FIG. 1 is a mere example. The spark plug can employ various other configurations.

Figure 2:
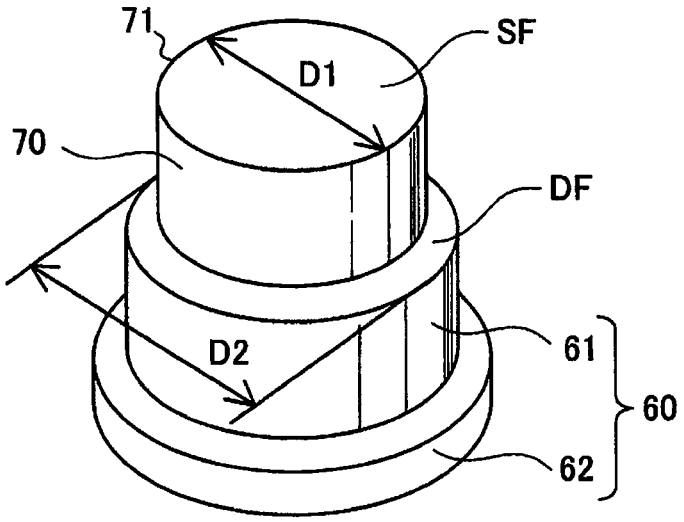
FIG. 2 is a perspective view showing a noble metal tip and an intermediate tip before joining them together.

FIG. 2 is a perspective view showing the noble metal tip 70 and the intermediate tip 60 before they are joined together. The noble metal tip 70 has a substantially circular columnar shape and has a gap formation face SF (also called the "top face" or "upper bottom face") perpendicular to the axis. In the spark plug 100, the gap formation face SF is disposed in such a manner as to face the forward end portion 22 of the center electrode 20. The gap formation face SF has a substantially circular shape with its edge 71 serving as the circumference of the circle. The intermediate tip 60 has a columnar portion 61 having a substantially circular cross section and a collar portion 62 radially expanding from the columnar portion 61. The top face of the columnar portion 61 functions as a disposition face DF on which the noble metal tip 70 is disposed. The disposition face DF has a substantially circular shape. The noble metal tip 70 is disposed on the disposition face DF of the intermediate tip 60 in such a manner that the axis of the noble metal tip 70 and the axis of the intermediate tip 60 are aligned with each other. Usually, a diameter D1 of the noble metal tip 70 is slightly smaller than a diameter D2 of the displacement face DF of the intermediate tip 60.

Figure 3:
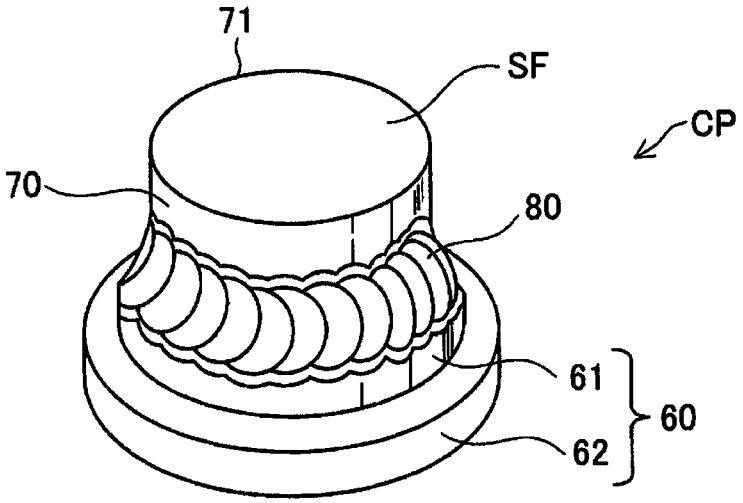
FIG. 3 is a perspective view showing a composite tip in which the noble metal tip and the intermediate tip are joined together.

FIG. 3 is a perspective view showing a composite tip CP in which the noble metal tip 70 and the intermediate tip 60 are joined together. The intermediate tip 60 and the noble metal tip 70 are joined together by laser welding or the like, yielding the composite tip CP. As a result of the welding, the fusion zone 80 is formed at the boundary between the intermediate tip 60 and the noble metal tip 70. The collar portion 62 of the composite tip CP is joined to the distal end portion 31 of the ground electrode 30 by resistance welding or the like.

Figure 4:
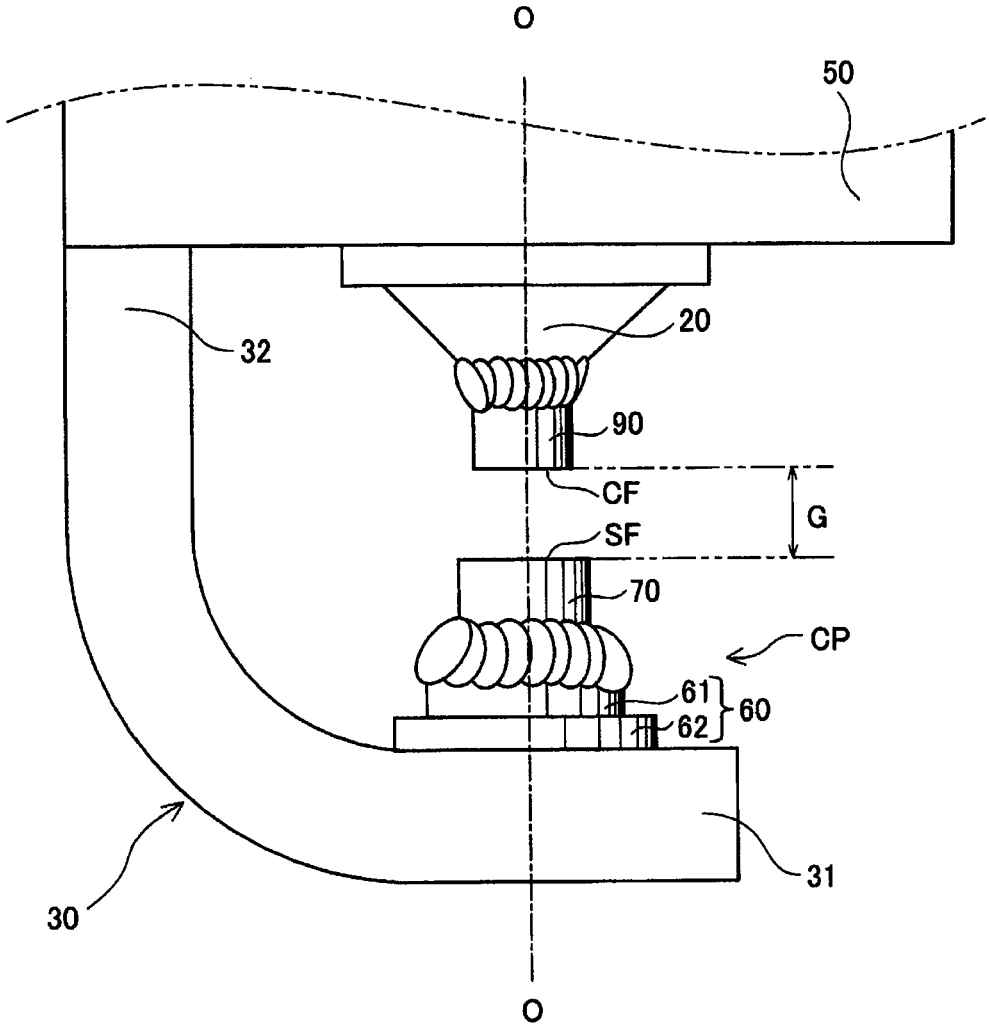
FIG. 4 is an enlarged view showing a forward end portion of a center electrode and its periphery.

FIG. 4 is an enlarged view showing a forward end portion of the center electrode 20 and its periphery. The composite tip CP is disposed where its axis is aligned with the axis of the center electrode 20. A spark gap G is formed between a bottom face CF of the center electrode 20 (herein, the bottom face of the noble metal tip 90) and the top face SF of the composite tip CP. In the example of FIGS. 1 to 4, the composite tip CP is provided at the distal end portion 31 of the ground electrode 30. However, the composite tip may be provided at a forward end portion of the center electrode 20. That is, preferably, the composite tip is provided at least one of the center electrode 20 and the ground electrode 30.

Figure 5:
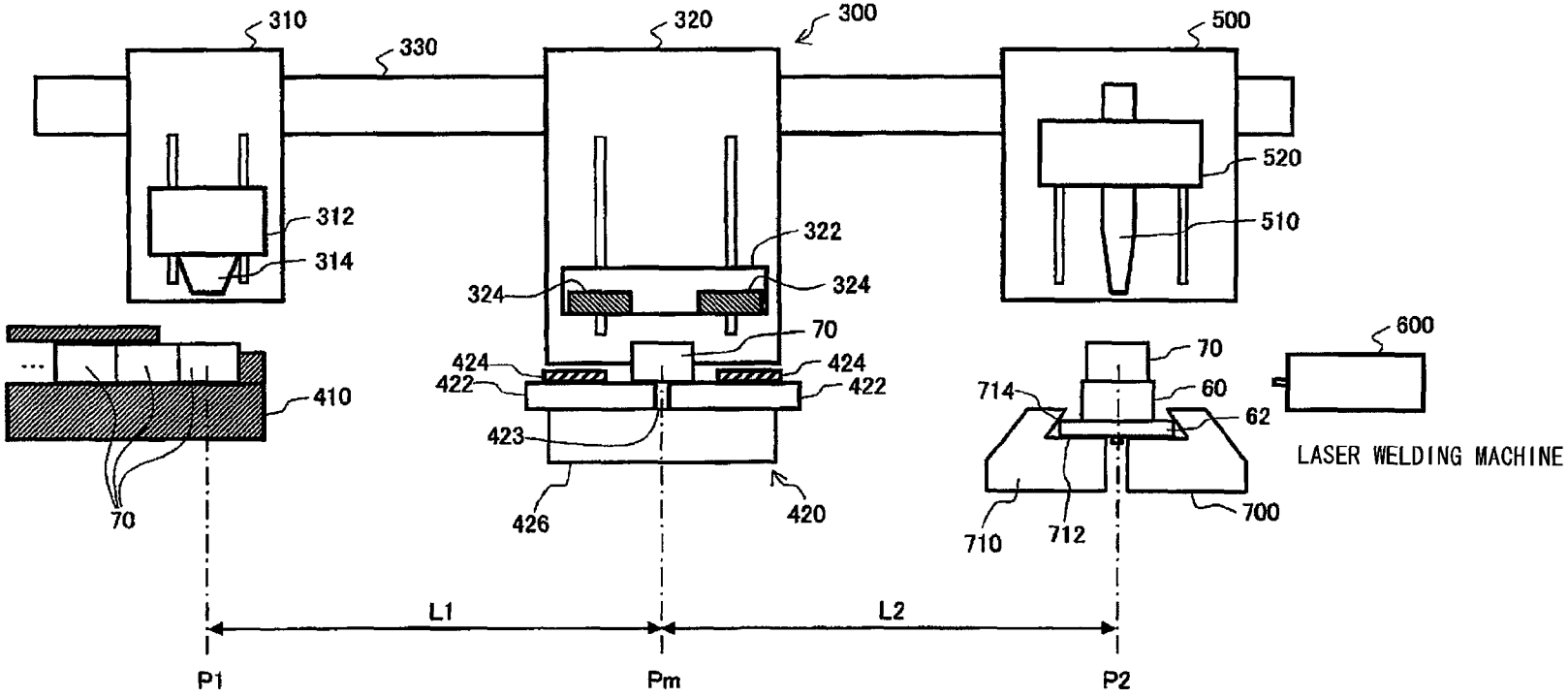
FIG. 5 is an explanatory view showing an example of a joining apparatus in a first embodiment.

FIG. 5 is an explanatory view showing an example of a joining apparatus for forming a composite tip through joining in the first embodiment. The joining apparatus includes a transfer device 300 having a first transfer device 310 and a second transfer device 320; a tip-pressing device 500; a first-tip feed device 410; a position-correcting device 420; a laser welding machine 600; and a tip support device 700. In the following description, the noble metal tip 70 is called the "first tip 70," and the intermediate tip 60 is called the "second tip 60." Since manufacture of spark plugs involves a large number of the first tips 70 and the second tips 60, when these tips need to be distinguished from one another, affixes indicative of order, such as "n" and "n−1," are affixed to the reference numerals 70 and 60 of the tips.

The first-tip feed device 410 is a part feeder for feeding the first tips 70. In the first-tip feed device 410, the position where the first tip 70 is picked up is called the "first-tip feed position P1."

The first transfer device 310 picks up the first tip 70 from the first-tip feed position P1 and transfers the picked-up first tip 70 to a position Pm on the position-correcting device 420. The first transfer device 310 has a vacuum chuck 314 for vacuum-chucking the first tip 70 at its top face, and a drive mechanism 312 for vertically moving the vacuum chuck 314.

The position-correcting device 420 has a placement table 422; a position-correcting chuck 424 provided on the placement table 422; and a tip suction device 426. The first tip 70 transferred by the first transfer device 310 is placed on the placement table 422. The placement table 422 on which the first tip 70 is placed has a vacuum chuck port 423 at the position Pm. Hereinafter, the position Pm may be called the "middle position Pm." The position-correcting chuck 424 corrects the position of the first tip 70 at the middle position Pm. The shape of the position-correcting chuck 424 and a method of positional correction by the position-correcting chuck 424 are described later. During the process of positional correction, the tip suction device 426 exerts suction on the bottom face of the first tip 70 through the vacuum chucking port 423 of the placement table 422, thereby securing the first tip 70 on the placement table 422. The tip suction device 426 and the vacuum chucking port 423 may be eliminated.

The second transfer device 320 transfers the first tip 70 from the position. Pm on the position-correcting device 420 to a position P2 on the tip support device 700. The second transfer device 320 has a transfer chuck 324 for gripping the first tip 70 at its side, and a drive mechanism 322 for vertically moving the transfer chuck 324.

The tip support device 700 supports the second tip 60. Specifically, the tip support device 700 has a plurality of grippers 710, each having a placement surface 712 and a gripping claw 714. These grippers 710 are configured such that their gripping claws 714 can shift or pivotally move toward the position P2 of the center of the tip support device 700. These grippers 710 grip the collar portion 62 of the second tip 60 from the outside radial direction, thereby supporting the second tip 60 at the position P2. In the gripped condition, the bottom face of the collar portion 62 rests on the placement surfaces 712 of the grippers 710, and an upper edge of the collar portion 62 is pressed by the inner surfaces of the gripping claws 714. Since a plurality of (e.g., three) grippers 710 are provided around the second tip 60, by means of the plurality of grippers 710 gripping the second tip 60, the center of the second tip 60 is correctly positioned at the center position P2 of the tip support device 700. In order to enhance the positioning function of the grippers 710, preferably, as shown in FIG. 5, the placement surface 712 and the inner surfaces of the gripping claws 714 form an acute angle.

After the second transfer device 320 transfers the first tip 70 and then places it on the second tip 60, the tip-pressing device 500 presses the first tip 70 from above. The tip-pressing device 500 has a pressing jig 510 for pressing the first tip 70, and a drive mechanism 520 for vertically moving the pressing jig 510.

In a state in which the second tip 60 and the first tip 70 are sequentially placed on the tip support device 700, and the tip pressing unit 500 presses the first tip 70, the laser welding machine 600 welds the first tip 70 and the second tip 60 at their boundary to join them together, thereby forming the composite tip. This joining work is performed in a state in which the first tip 70 and the second tip 60 are situated at the center position P2 of the tip support device 700. Thus, this position P2 is also called the "joining position."

The first transfer device 310, the second transfer device 320, and the tip-pressing device 500 can move horizontally along a horizontally extending rail 330. The first transfer device 310 and the second transfer device 320 are driven by an unillustrated drive unit and can move simultaneously in the horizontal direction with a distance L1 therebetween held at a fixed value. Also, the second transfer device 320 and the tip-pressing device 500 are driven by an unillustrated drive unit and can move simultaneously in the horizontal direction with a distance L2 therebetween held at a fixed value. However, one or two of the three devices 310, 320, and 500 may be moved independently of the other one(s), or the three devices 310, 320, and 500 may be moved independently of one another.

Preferably, the distance L1 between the first-tip feed position P1 and the middle position Pm is equal to the distance L2 between the middle position Pm and the joining position P2. Through employment of this distance relationship, by means of simultaneous rightward move in FIG. 5 of the first transfer device 310 and the second transfer device 320 which grip the respective first tips 70, the two first tips 70 can be simultaneously transferred.

Figure 6:
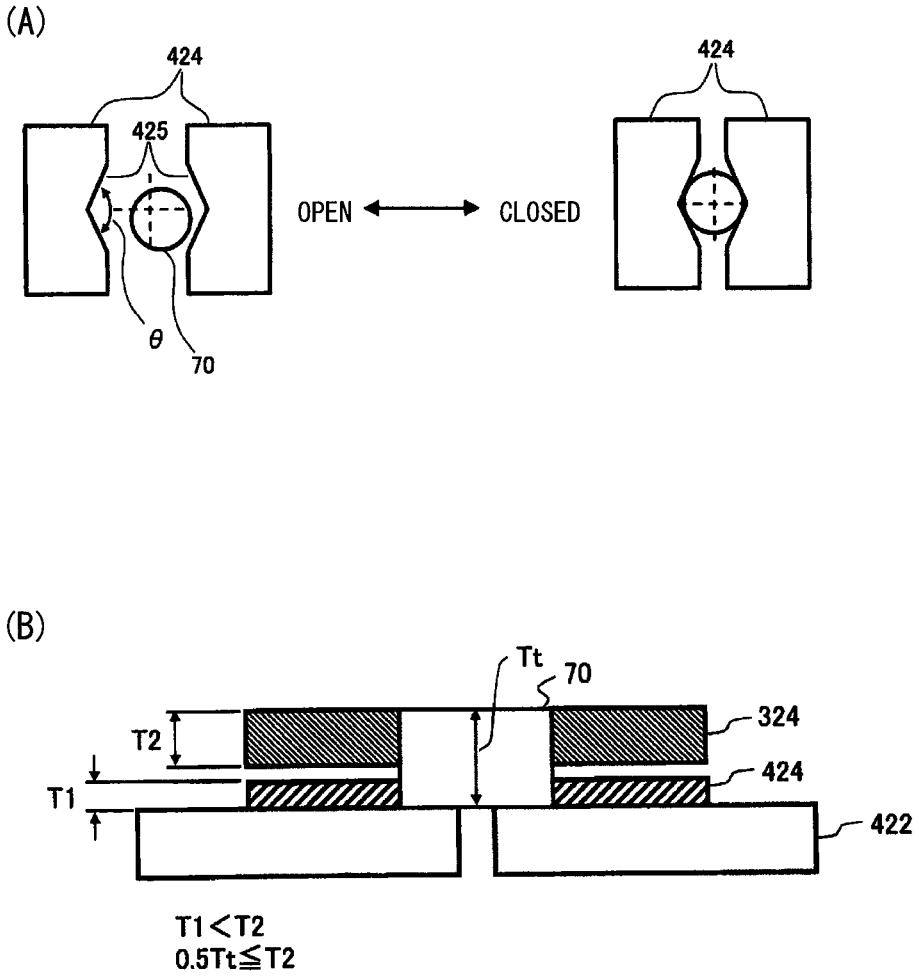
FIG. 6 is a set of explanatory views showing the shapes of chucks.

FIG. 6(A) is an explanatory view showing the shape of the chuck. As shown in FIG. 6(A), the position-correcting chuck 424 is composed of two chuck members, each having a gripping recess 425. Each of the gripping recesses 425 is formed of two planes which form an angle θ. When the first tip 70 is gripped at its side between the two gripping recesses 425, the first tip 70 automatically undergoes positional correction so as to come to the center position between the two gripping recesses 425 (i.e., the center position of the position-correcting chuck 424). Notably, the "center position between the two gripping recesses 425" is the one in a state (closed state) in which the two gripping recesses 425 grip the first tip 70 at its side therebetween. In this gripping condition, a predetermined gap is present between the two chuck members (i.e., between the two gripping recesses 425). The angle θ of the gripping recesses 425 is preferably 10 degrees to 170 degrees, particularly preferably 90 degrees to 160 degrees. This angle is experimentally determined so as to correctly perform positional correction for the first tip 70.

The transfer chuck 324 of the second transfer device 320 can also be configured to be similar to the position-correcting chuck 424 in the shape of a gripping portion. Alternatively, the transfer chuck 324 and the position-correcting chuck 424 may differ in the shape of a gripping portion. However, preferably, the shapes of the gripping portions of the transfer chuck 324 and the position-correcting chuck 424 are determined such that the tip center position of the position-correcting chuck 424 in a gripping condition and the tip center position of the transfer chuck 324 in a gripping condition coincide with each other.

FIG. 6(B) shows the relationship of thickness between the position-correcting chuck 424 and the transfer chuck 324. FIG. 6(B) shows a state in which, after completion of positional correction performed on the placement table 422 by means of the position-correcting chuck 424, the transfer chuck 324 grips the first tip 70. In this state, the position-correcting chuck 424 grips the first tip 70 at a lower portion of its side surface, while the transfer chuck 324 grips the first tip 70 at an upper portion of its side surface. Then, the position-correcting chuck 424 opens and thereby releases the first tip 70, and, while gripping the first tip 70, the transfer chuck 324 transfers the first tip 70 to the joining position P2. In order to prevent deviation of the position of the first tip 70 relative to the transfer chuck 324 from a proper grip position in the midst of the transfer, preferably, the transfer chuck 324 has a sufficiently large thickness T2. Specifically, preferably, the thickness T2 of the transfer chuck 324 is greater than a thickness T1 of the position-correcting chuck 424. Also, preferably, the thickness T2 of the transfer chuck 324 is equal to or greater than half of a thickness Tt of the first tip 70 (0.5 Tt).

Figure 7:
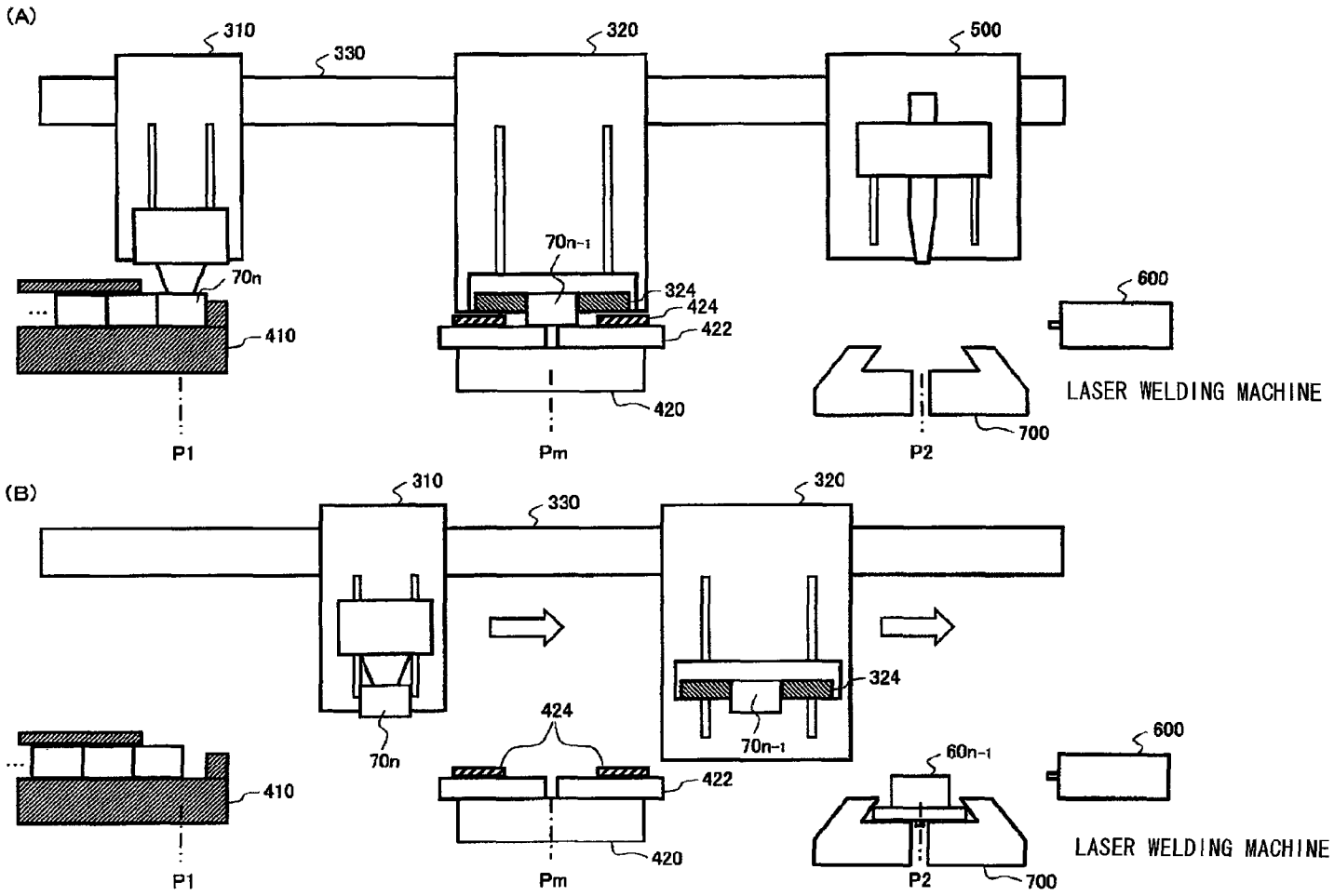
FIG. 7 is a set of explanatory views showing a joining process for forming the composite tip.
Figure 8:
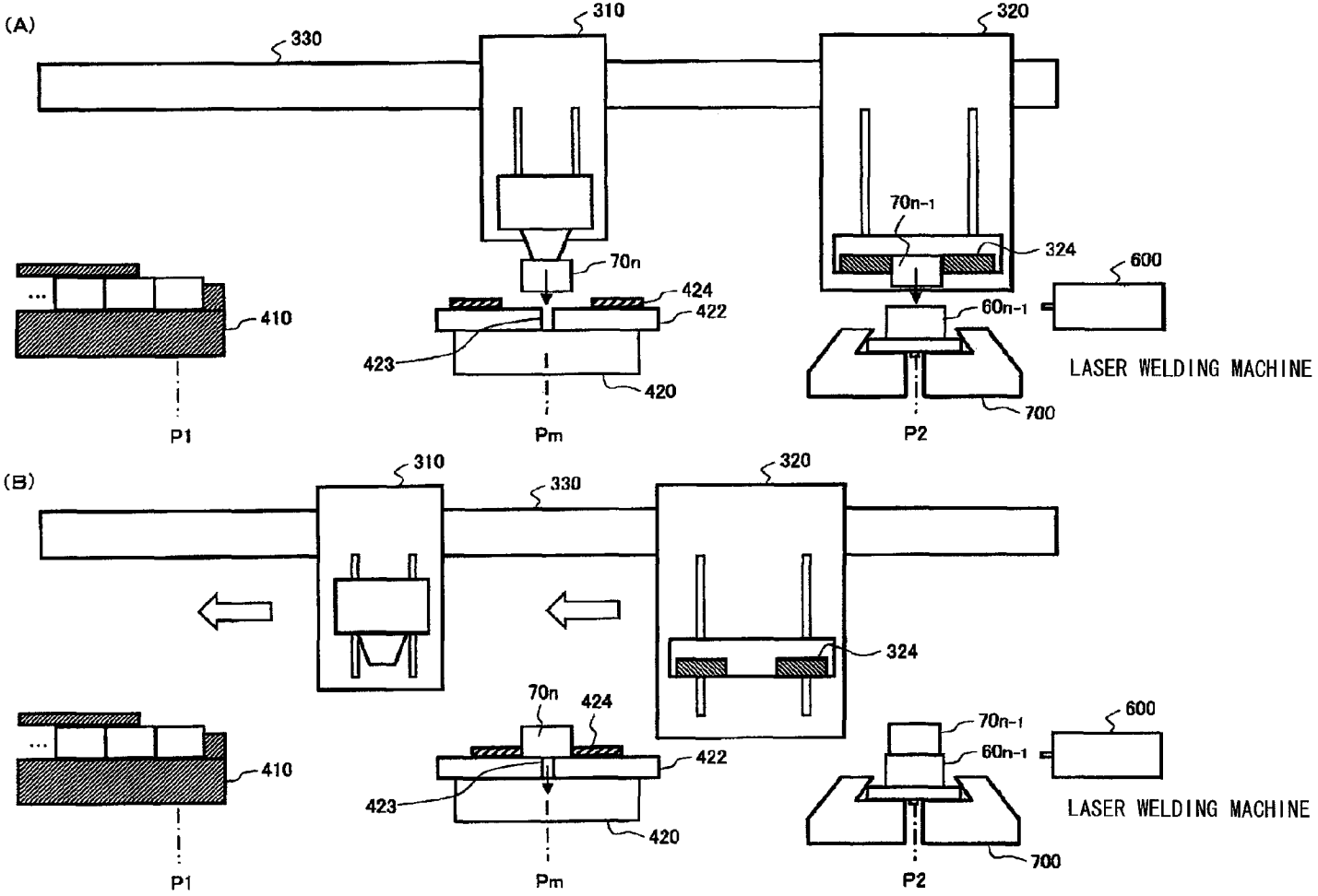
FIG. 8 is a set of explanatory views showing the joining process for forming the composite tip.

FIGS. 7(A) and 7(B) to FIGS. 9(A) and 9(B) are explanatory views showing a joining process for forming the composite tip. FIG. 7(A) shows a state in which the first tips 70*n* and 70*n*−1 are held. In this state, the first transfer device 310 vacuum-chucks the first tip 70*n* with the vacuum chuck 314 at the feed position P1 of the first-tip feed device 410, whereas the second transfer device 320 grips the first tip 70*n*−1 with the transfer chuck 324 at the middle position Pm on the placement table 422. Subsequently, the first transfer device 310 transfers the first tip 70*n* from the feed position P1 to the middle position Pm, and, at the same time, the second transfer device 320 transfers the other first tip 70*n*−1 from the middle position Pm to the joining position P2 (FIG. 7(B)). In parallel with the transfer, a second tip 60*n*−1 is fed onto the tip support device 700 by a second-tip feed device (not shown) and is held on the tip support device 700.

FIG. 8(A) shows a state in which, after the two first tips 70*n* and 70*n*−1 are transferred to positions above the middle position Pm and the joining position P2, respectively, the first tips 70*n* and 70*n*−1 are lowering. As a result, the first tip 70*n* transferred by the first transfer device 310 is placed on the placement table 422 of the position-correcting device 420, whereas the first tip 70*n*−1 transferred by the second transfer device 320 is placed on the second tip 60*n*−1 supported by the tip support device 700 at the joining position P2. At this time, the first tip 70*n* placed at the middle position Pm undergoes the aforementioned positional correction (FIGS. 6(A) and 6(B)) performed by the position-correcting chuck 424. This positional correction is performed with the bottom face of the first tip 70*n* being vacuum-chucked through the vacuum chuck port 423 provided in the placement table 422. Therefore, when the position-correcting chuck 424 is to grip the first tip 70*n*, an unintended movement (for example, the position-correcting chuck 424 flicks the first tip 70*n*) can be restrained. Upon completion of the placing operation and the position correcting operation, the first transfer device 310 and the second transfer device 320 release the respective tips and then move back toward the original positions P1 and Pm, respectively, in an unloaded condition (FIG. 8(B)). The position-correcting chuck 424 may perform positional correction in parallel with the returning movement of the first transfer device 310 and the second transfer device 320 toward the original positions P1 and Pm. In this case, when the first tip 70*n* is placed on the placement table 422, the first tip 70*n* is vacuum-chucked and held through the vacuum chuck port 423; then, after the first transfer device 310 releases the first tip 70*n*, the positional correction is performed.

Figure 9:
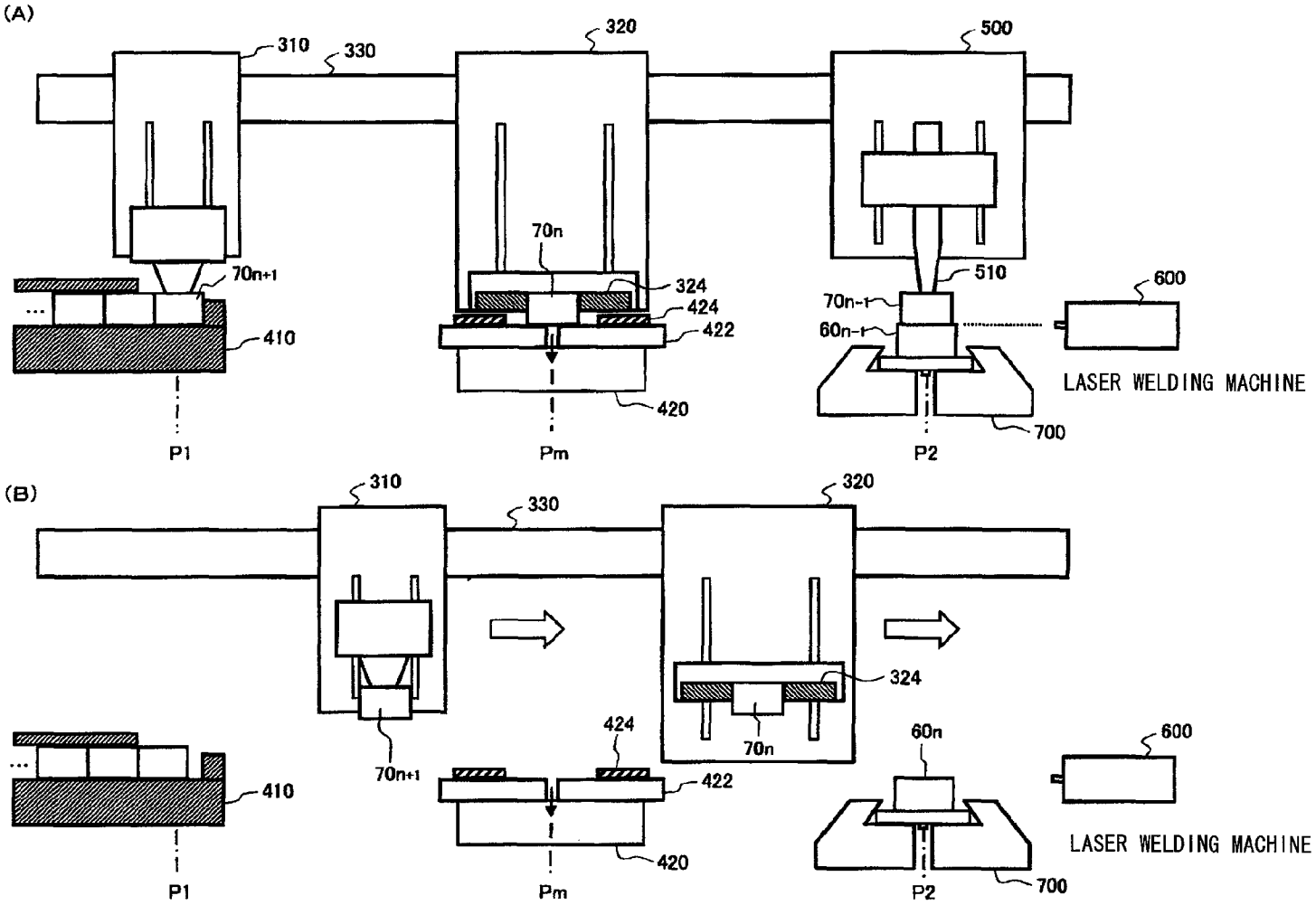
FIG. 9 is a set of explanatory views showing the joining process for forming the composite tip.

FIG. 9(A) shows a state in which the first transfer device 310 and the second transfer device 320 are back at the positions P1 and Pm, respectively, and hold the next first tips 70*n*+1 and 70*n*, respectively. At this time, the tip-pressing device 500 is also back at the joining position P2 and presses downward the top face of the first tip 70*n*−1. Also, the laser welding machine 600 welds the first tip 70*n*−1 and the second tip 60*n*−1 together. As a result, the composite tip composed of the tips 70*n*−1 and 60*n*−1 is formed. Subsequently, the first transfer device 310 transfers the first tip 70*n*+1 from the feed position P1 to the middle position Pm, and, at the same time, the second transfer device 320 transfers the first tip 70*n* from the middle position Pm to the joining position P2 (FIG. 9(B)). In parallel with the transfer, unillustrated another transfer device transfers the composite tip formed in FIG. 9(A) from the tip support device 700 to another place. Operations of the first transfer device 310 and the second transfer device 320 in FIGS. 9(A) and 9(B) are similar to those of the first and second transfer devices 310 and 320 in FIGS. 7(A) and 7(B). Subsequently, the operations described above with reference to FIGS. 7(A) and 7(B) to FIGS. 9(A) and 9(B) are repeated, thereby yielding the composite tips one after another.

In the first embodiment, the position-correcting device 420 performs positional correction for the first tip 70 mainly for the following reason. As mentioned above, the first transfer device 310 vacuum-chucks the first tip 70 at its top face and transfers the first tip 70. Therefore, great variation is likely to arise in the vacuum-chucking position (holding position) on the first tip 70 to be vacuum-chucked (held) by the first transfer device 310. If the first transfer device 310 transfers the first tip 70 from the feed position P1 to the joining position P2, the first tip 70 may possibly fail to be correctly placed at the joining position P2. Thus, in the first embodiment, at the middle position Pm, the position-correcting device 420 corrects the first tip 70 to a correct position; subsequently, the second transfer device 320 which holds the first tip 70 by means other than vacuum chuck transfers the first tip 70 from the middle position Pm to the joining position P2. Through employment of such process, the first tip 70 can be placed correctly at the joining position P2.

As described above, according to the first embodiment, in the course of transfer of the first tip 70 from the feed position P1 of the first tip 70 to the joining position P2 where the composite tip is manufactured, positional correction is performed on the first tip 70; therefore, the positional relationship between the two tips which constitute the composite tip can be adjusted easily and correctly. Also, according to the first embodiment, particularly, since positional correction is performed in a state in which the first tip 70 is placed at the middle position Pm located at the center between the feed position P1 and the joining position P2, as compared with the case where positional correction is performed on the first tip 70 in the process of transfer, positional correction can be performed easily and correctly. Furthermore, at the middle position Pm, positional correction can be performed in a sufficiently loose condition in terms of time and position. Also, since the middle position Pm where positional correction is performed is located at the center between the feed position P1 and the joining position P2, transfer by the first transfer device 310 from the feed position P1 to the middle position Pm and transfer by the second transfer device 320 from the middle position Pm to the joining position P2 can be performed simultaneously. As a result, individual transfer distances become short, thereby shortening working time required to manufacture the composite tip.

Also, according to the first embodiment, positional correction for the first tip 70 is performed before the first tip 70 reaches the joining position P2. Thus, since the step of positional correction for the first tip 70 and the step of joining the first and second tips together can be performed separately at respectively favorable timings, production efficiency can be improved.

B. Second Embodiment

Figure 10:
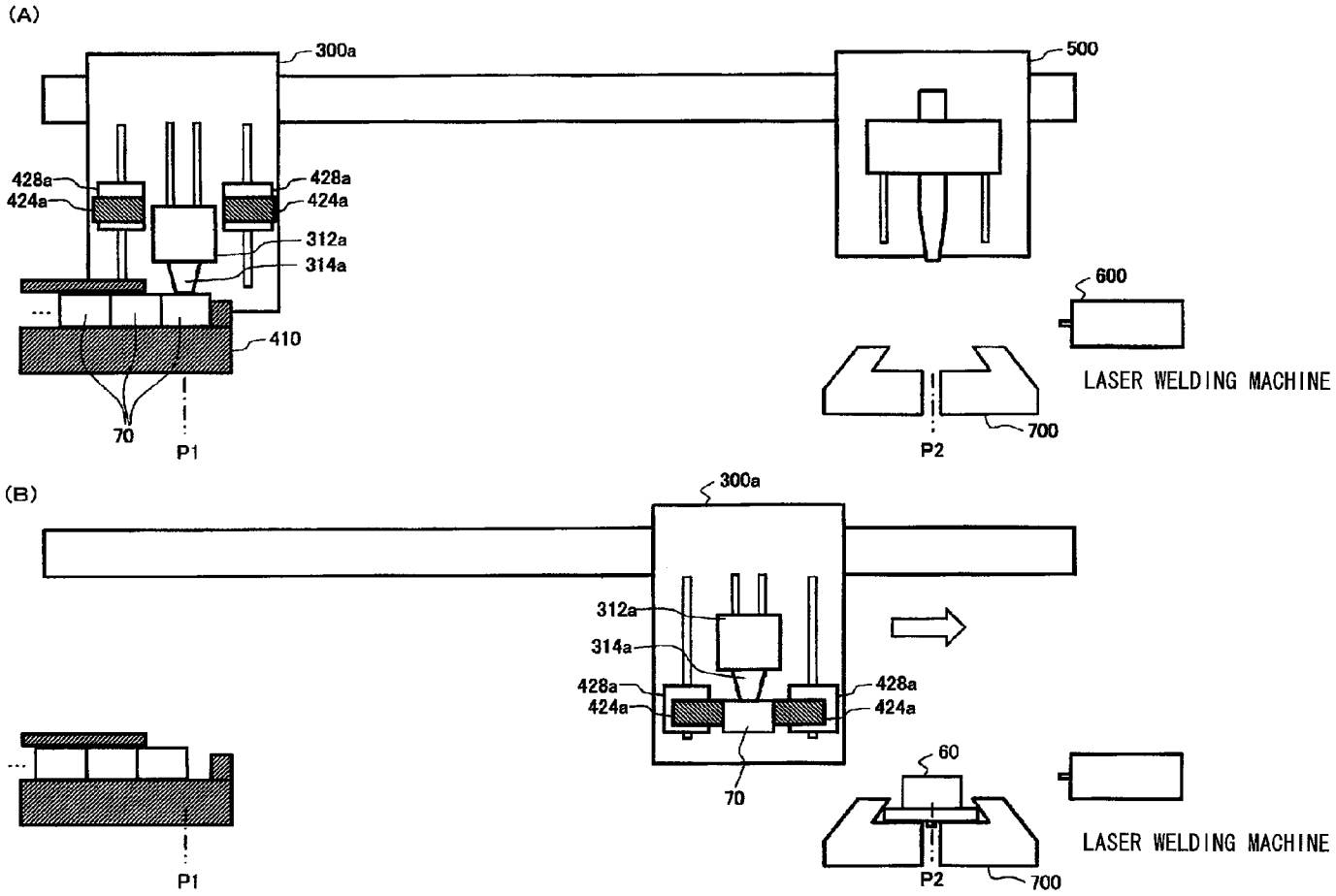
FIG. 10 is a set of explanatory views showing an example of a joining apparatus in a second embodiment of the present invention.

FIGS. 10(A) and 10(B) are explanatory views showing a joining apparatus in a second embodiment of the present invention and the operation of the joining apparatus and correspond to FIGS. 7(A) and 7(B) showing the joining process in the first embodiment. The second embodiment differs from the first embodiment only in that a single transfer device 300*a* replaces collectively all of the first transfer device 310, the second transfer device 320, and the position-correcting device 420. Other configurational features are similar to those of the first embodiment. Specifically, the transfer device 300*a* of the second embodiment has a vacuum chuck 314*a* for vacuum-chucking, from the first-tip feed device 410, the first tip 70 at its top face; a drive mechanism 312*a* for vertically moving the vacuum chuck 314*a*; a position-correcting chuck 424*a* which grips the first tip 70 at its side and performs positional correction for the first tip 70; and a drive mechanism 428*a* for vertically moving the position-correcting chuck 424*a*. Notably, each of the position-correcting chuck 424*a* and the drive mechanism 428*a* is divided into right and left halves so as to be able to vertically move on the opposite sides of the vacuum chuck 314*a*.

As shown in FIG. 10(A), when a new tip is to be held, the vacuum chuck 314*a* vacuum-chucks the first tip 70 at the feed position P1 and then moves upward for picking up the one tip. At this time, the position-correcting chuck 424*a* is in an open state (in a standby state). When the one first tip 70 is picked up in this manner, the transfer device 300*a* moves rightward in FIG. 10(A) toward the joining position P2. FIG. 10(B) shows the state of the movement. During the transfer by the transfer device 300*a*, the position-correcting chuck 424*a* moves downward and changes from the open state to a closed state to thereby grip the first tip 70 at its side. The position-correcting chuck 424*a* has a shape similar to that of the first embodiment shown in FIG. 6(A). Therefore, by means of the position-correcting chuck 424*a* gripping the first tip 70 at its side, the position of the first tip 70 is corrected to the center position of the position-correcting chuck 424*a*. Subsequently, while the first tip 70 is vacuum-chucked at its top face by the vacuum chuck 314*a* and gripped at its side by the position-correcting chuck 424*a*, the transfer device 300*a* moves to the joining position P2. Then, the drive mechanisms 312*a* and 428*a* operate to lower the vacuum chuck 314*a* and the position-correcting chuck 424*a*, respectively, and the first tip 70 is thereby placed on the second tip 60.

In the second embodiment, in transfer after positional correction shown in FIG. 10(B), vacuum chucking by the vacuum chuck 314*a* may not be employed. In this case, the position-correcting chuck 424*a* carries out a function similar to that of the transfer chuck 324 in the first embodiment. Also, in the second embodiment, the position-correcting chuck 424*a* may be configured to not vertically move.

As mentioned above, in the second embodiment, positional correction for the first tip 70 is performed during transfer of the first tip 70; therefore, the configuration of the transfer apparatus becomes simple. Also, since positional correction for the first tip can be performed during transfer (i.e., during movement), there can be shortened time required for the entire process which includes transfer of and positional correction for the first tip 70.

C. Third Embodiment

Figure 11:
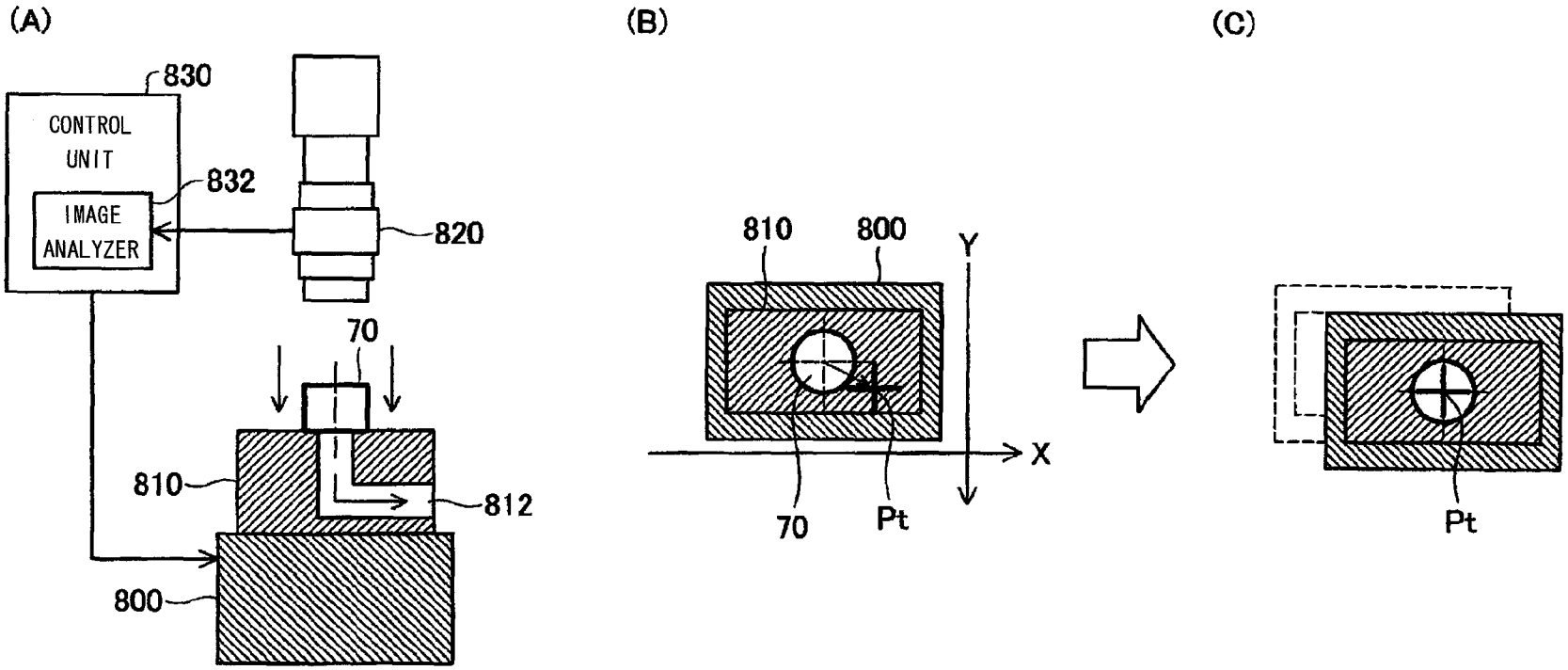
FIG. 11 is a set of explanatory views showing positional correction work for a tip to be conducted at a middle position in a third embodiment of the present invention.

FIGS. 11(A) to 11(C) are explanatory views showing positional correction work for a tip to be conducted at a middle position in a third embodiment of the present invention and correspond to FIGS. 6(A) and 6(B) showing that in the first embodiment. In the third embodiment, in place of the position-correcting chuck 424 shown in FIG. 6(A), a servo stage 800 and a camera 820 are used to perform positional correction for the first tip 70. The servo stage 800 shown in FIG. 11(A) is a table which can perform two-dimensional positioning through utilization of a servo-mechanism. A vacuum chuck block 810 having a vacuum chuck hole 812 is fixed on the servo stage 800. The vacuum chuck block 810 functions as a placement table on which the first tip 70 is placed. The vacuum chuck hole 812 has a vacuum chuck port which opens at the upper surface of the vacuum chuck block 810, and is connected to a vacuum pump (not shown). The camera 820 is disposed above the vacuum chuck block 810 and can capture an image of a wide region, including the vacuum chuck hole 812, of the upper surface of the vacuum chuck block 810. The servo stage 800 and the camera 820 are electrically connected to a control unit 830. The control unit 830 includes an image analyzer 832.

As shown in FIG. 11(A), when the first tip 70 is placed on the vacuum chuck block 810, the bottom face of the first tip 70 is vacuum-chucked on the vacuum chuck block 810 by means of vacuum suction through the vacuum chuck hole 812, and the first tip 70 is thereby held at the position. In this condition, the camera 820 captures an image of the first tip 70. FIG. 11(B) shows an example of a thus-captured image, and X and Y indicate a coordinate system of the camera. In this example, the actual position of the center of the first tip 70 deviates from a target position Pt. The target position Pt is a preset position in the coordinate system of the camera; for example, the target position Pt can be set at the center of the initial position (default position) of the camera 820. The target position Pt does not need to be marked in an image, but may be set at a position which the image analyzer 832 can recognize. As shown in FIG. 11(B), in the case where the actual position of the center of the first tip 70 deviates from the target position Pt, the control unit 830 adjusts the position of the servo stage 800 so as to establish the coincidence between the actual position of the center of the first tip 70 and the target position Pt as shown in FIG. 11(C).

As mentioned above, according to the third embodiment, the camera 820 captures an image of the first tip 70 whose bottom face is vacuum-chucked on the servo stage 800, and, through utilization of the captured image, the position of the first tip 70 is corrected; therefore, the third embodiment has an advantage that positioning can be accurately performed by means of a simple configuration.

D. Method for Manufacturing Spark Plug

Figure 12:
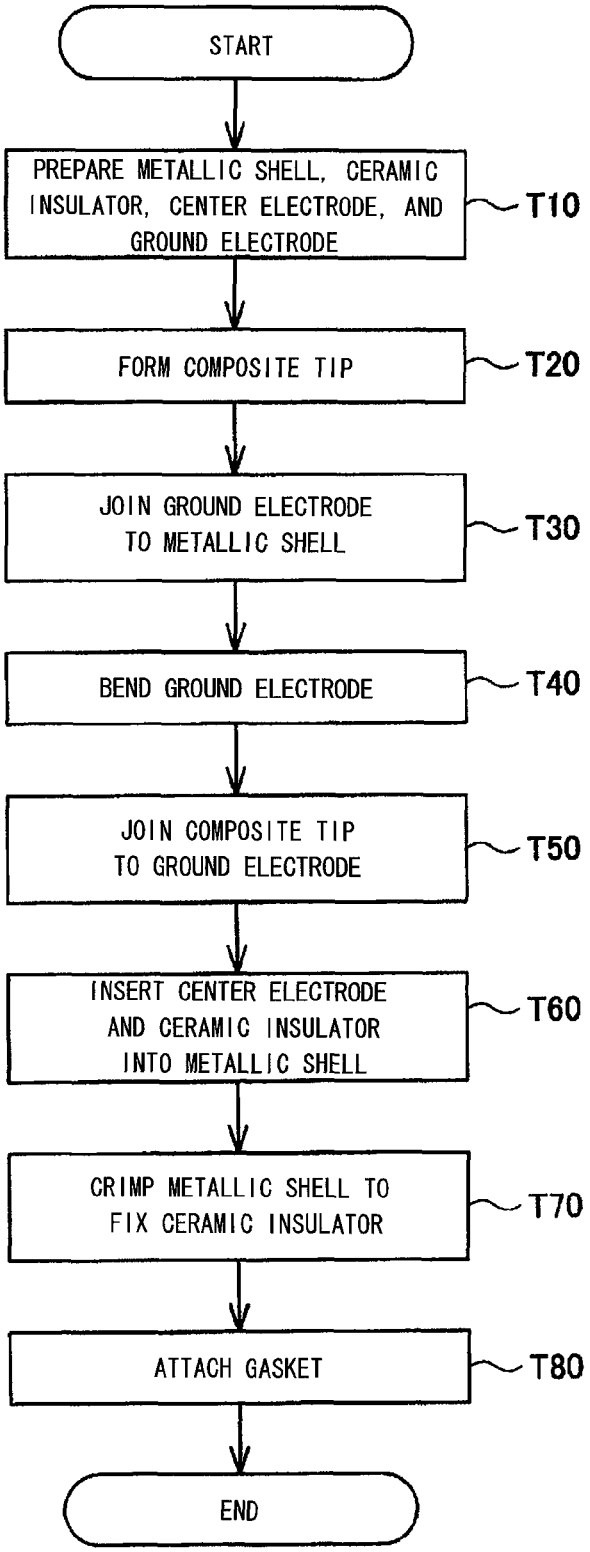
FIG. 12 is a flowchart showing a method for manufacturing a spark plug.

FIG. 12 is a flowchart showing a method for manufacturing a spark plug according to an embodiment of the present invention. In step T10, the metallic shell 50, the ceramic insulator 10, the center electrode 20, and the ground electrode 30 are prepared. In step T20, the composite tip CP is formed by joining the first tip 70 and the second tip 60 together. The step of forming the composite tip CP is performed according to any one of the above-described procedures of the first to third embodiments. In step T30, the ground electrode 30 is joined to the metallic shell 50. In step T40, a distal end portion of the ground electrode 30 is bent by use of a bending tool (not shown). In step T50, the composite tip CP is joined to the distal end portion 31 of the ground electrode 30 (FIG. 4). This joining work is carried out through utilization of, for example, resistance welding. In step T60, an assembling step is performed through insertion of the center electrode 20 and the ceramic insulator 10 into the metallic shell 50. The assembling step yields an assembly in which the ceramic insulator (insulator) 10 and the center electrode 20 are incorporated into the metallic shell 50. The assembling step may employ either one of the following methods: a method in which the ceramic insulator 10 incorporated with the center electrode 20 is incorporated into the metallic shell 50, and a method in which after the ceramic insulator 10 is incorporated into the metallic shell 50, the center electrode 20 is incorporated into the ceramic insulator 10. In step T70, by use of a crimping tool (not shown), crimping work is performed on the metallic shell 50. The crimping work fixes the ceramic insulator 10 to the metallic shell 50. In step T80, the gasket 5 is fitted to the mounting threaded portion 52 of the metallic shell 50, thereby completing the spark plug 100.

The manufacturing method shown in FIG. 12 is a mere example, and various methods different from the example method are available for manufacturing a spark plug. For example, the order of the steps T10 to T80 can be varied to a certain extent.

MODIFICATIONS

The present invention is not limited to the above-described embodiments or modes, but may be embodied in various other forms without departing from the gist of the invention. For example, the following modifications are also possible.

Modification 1

In the above-described embodiments, the first transfer device 310 vacuum-chucks and holds the first tip 70. However, even in the case where the first transfer device 310 employs means other than vacuum chuck for holding the first tip 70, the present invention can be applied. In this case also, by means of the position-correcting chuck 424 performing positional correction for the first tip 70, the first tip 70 can be placed correctly at the joining position P2.

Modification 2

The position-correcting chuck 424 can employ various shapes other than that shown in FIG. 6(A). Preferably, the position correcting chuck 424 is shaped such that, when the position-correcting chuck 424 grips the first tip 70 at its side, the first tip 70 is automatically moved to the center position of the position-correcting chuck 424.

Modification 3

The above embodiments are described while mentioning the case of joining the first and second tips together for forming the composite tip. However, the present invention is not limited thereto, but can be applied to the case of joining a particular first tip to a tip-mating member. For example, the present invention can be applied to the case where a noble metal tip is directly joined or welded to the center electrode or the ground electrode. In this case, the noble metal tip corresponds to the "first tip," and the center electrode or the ground electrode corresponds to the "tip-mating member." In the above-described embodiments, it is understandable that the second tip corresponds to the "tip-mating member."

In the case where the tip-mating member is a thin member (a member having a small cross section), such as the second tip 60 or the center electrode, joining the first tip to the tip-mating member requires accurate positioning of the first tip to a greater extent. Even in such a case, the present invention is effective, since positioning of the first tip can be performed simply and accurately. Particularly, in the case where a diametrical difference between the first tip and the tip-mating member is very small (e.g., the diametrical difference is 0.1 mm or less), the present invention is particularly effective.

DESCRIPTION OF REFERENCE NUMERALS

3: ceramic resistor
4: seal member
5: gasket
6: ring member
7: ring member
8: seat packing
9: talc
10: ceramic insulator
12: axial bore
13: leg portion
15: stepped portion
17: forward trunk portion
18: rear trunk portion
19: collar portion
20: center electrode
21: electrode base metal
22: forward end portion
25: core
30: ground electrode
31: forward end portion
32: proximal portion
40: metal terminal
50: metallic shell
51: tool engagement portion
52: mounting threaded portion
53: crimped portion
54: seal portion
55: seat surface
56: stepped portion
57: forward end surface
58: buckled portion
59: screw neck
60: intermediate tip (second tip)
61: columnar portion
62: collar portion
70: noble metal tip (first tip)
71: edge
80: fusion zone
90: noble metal tip
100: spark plug
200: engine head
201: mounting threaded hole
205: peripheral-portion-around-opening
300: transfer device
310: first transfer device
312: drive mechanism
314: vacuum chuck
320: second transfer device
322: drive mechanism
324: transfer chuck
330: rail
410: first-tip feed device
420: position-correcting device
422: placement table
423: vacuum chuck port
424: position-correcting chuck
425: gripping recess
426: tip suction device
428*a*: drive mechanism
500: tip-pressing device
510: pressing jig
520: drive mechanism
600: laser welding machine
700: tip support device
710: gripper
712: placement surface
714: gripping claw
800: servo stage
810: vacuum chuck block
812: vacuum chuck hole
820: camera
830: control unit
832: image analyzer

The invention claimed is:

1. A method for manufacturing a spark plug comprising the steps of:

providing a center electrode;

providing an insulator disposed externally of an outer circumference of the center electrode;

providing a metallic shell disposed externally of an outer circumference of the insulator providing a ground electrode whose one end portion is joined to the metallic shell and whose other end portion faces the center electrode;

providing a first tip which forms a gap in cooperation with the ground electrode or the center electrode, said first tip being disposed at the center electrode and/or the ground electrode and being joined to a tip-mating member; and transferring the first tip to a joining position where the first tip is joined to the tip-mating member, wherein the transfer step comprises a step of performing positional correction for the first tip before the first tip reaches the joining position and further comprising:

(a) a step of moving, by use of a first feed device, the first tip to a middle position between a feed position where the first tip is fed, and the joining position;

(b) a step of performing positional correction for the first tip at the middle position by gripping the first tip using a position-correcting chuck which grips the first tip; and (c) a step of, after the positional correction, moving the first tip from the middle position to the joining position by use of a transfer chuck, with the first tip being chucked with the transfer chuck, the first feed device and the transfer chuck are configured such that transfer is repeated with a horizontal distance therebetween being fixed:

there are simultaneously performed:

a first moving process in which, in the step (a), the first feed device moves one first tip from the feed position to the middle position, and a second moving process in which, in the step (c), the transfer chuck moves another first tip from the middle position to the joining position, and the positional correction in the step (b) is performed in the course of return of the first feed device from the middle position to the feed position and in the course of return of the transfer chuck from the joining position to the middle position.

2. The method for manufacturing a spark plug according to claim 1, wherein the positional correction for the first tip is performed by gripping the first tip using a position-correcting chuck.

3. The method for manufacturing a spark plug according to claim 1, wherein the positional correction is performed at a middle position between a feed position where the first tip is fed, and the joining position.

4. The method for manufacturing a spark plug according to claim 1, wherein a gripping member of the transfer chuck has a thickness greater than that of a gripping member of the position-correcting chuck.

5. The method for manufacturing a spark plug according to claim 1 wherein positional correction for the first tip is performed in a state in which a bottom surface of the first tip is vacuum-chucked by use of a vacuum chuck port provided in a placement table on which the first tip is placed.

6. The method for manufacturing a spark plug according to claim 1, wherein at least one of the center electrode and the ground electrode has a composite tip;

the composite tip is such that a first tip which forms a gap in cooperation with the center electrode or the ground electrode, and a second tip which connects the first tip to the center electrode or the ground electrode, are joined together; and the second tip is the tip-mating member.

7. The method for manufacturing a spark plug according to claim 1, wherein the center electrode is the tip-mating member.

8. The method for manufacturing a spark plug according to claim 1, wherein the ground electrode is the tip-mating member.

9. The method for manufacturing a spark plug according to claim 1, wherein the tip-mating member is made of a material different from the ground electrode.

10. The method for manufacturing a spark plug according to claim 9, wherein the tip-mating member is made of a nickel alloy which contains an element selected from the group consisting of chromium, silicon, manganese and aluminum.

11. The method for manufacturing a spark plug according to claim 1, wherein in the transfer step, the first tip is transferred with a moving transfer device.

12. The method for manufacturing a spark plug according to claim 11, wherein the positional correction for the first tip is performed while the transfer device is moving.

13. A method for manufacturing a spark plug comprising the steps of:

providing a center electrode;

providing an insulator disposed externally of an outer circumference of the center electrode;

providing a metallic shell disposed externally of an outer circumference of the insulator providing a ground electrode whose one end portion is joined to the metallic shell and whose other end portion faces the center electrode;

providing a first tip which forms a gap in cooperation with the ground electrode or the center electrode, said first tip being disposed at the center electrode and/or the ground electrode and being joined to a tip-mating member; and transferring the first tip to a joining position where the first tip is joined to the tip-mating member, wherein the transfer step comprises a step of performing positional correction for the first tip before the first tip reaches the joining position, and the tip-mating member is made of a material different from the ground electrode.

14. The method for manufacturing a spark plug according to claim 13, wherein the tip-mating member is made of a nickel alloy which contains an element selected from the group consisting of chromium, silicon, manganese and aluminum.

* * * * *